United States Patent [19]

Savoca et al.

[11] Patent Number: 4,911,652

[45] Date of Patent: Mar. 27, 1990

[54] EMERGENCY POWER DISTRIBUTION SYSTEM

[75] Inventors: Paul F. Savoca, Patchhogue; Ronald A. Mackey, St. James, both of N.Y.; Robert J. Arnold, Framingham, Mass.

[73] Assignee: J.B. Nottingham & Co., Central Islip, N.Y.

[21] Appl. No.: 209,908

[22] Filed: Jun. 22, 1988

[51] Int. Cl.[4] ..... H01R 13/52

[52] U.S. Cl. ..... 439/282; 439/650; 439/576; 439/488; 439/206; 439/135

[58] Field of Search ..... 439/135, 281, 282, 205, 439/206, 207, 315, 472, 488, 489, 502–505, 576, 638, 650, 653, 142, 374; 174/59, 67, 66, 121 A, 112, 15.7, 72 R; 361/356, 358, 63; 307/147; 362/192

[56] References Cited

U.S. PATENT DOCUMENTS

| | | | |
|---|---|---|---|
| 2,009,004 | 7/1935 | Schatzel | 174/121 A |
| 2,015,101 | 9/1935 | Dieckmann | 439/488 |
| 2,039,916 | 5/1936 | McIntosh | 439/472 |
| 2,360,420 | 10/1944 | Hill | 362/192 |
| 2,410,277 | 10/1946 | Farris | 174/112 X |
| 2,677,115 | 4/1954 | Stevens | 439/282 |
| 2,995,670 | 8/1961 | Weiss | 307/147 |
| 3,109,690 | 11/1963 | Stevens, Jr. | 439/282 |
| 3,144,502 | 8/1964 | Weiss | 439/207 X |
| 3,159,443 | 12/1964 | Hart | 439/576 X |
| 3,611,255 | 10/1971 | Shroyer | 439/282 |
| 3,660,802 | 5/1972 | Staudt | 439/502 X |
| 3,786,312 | 1/1974 | Roussard | 361/356 |
| 4,037,907 | 7/1977 | Klimek et al. | 439/142 |
| 4,058,358 | 11/1977 | Carlisle | 439/142 |
| 4,159,858 | 7/1979 | Toraya | 174/67 X |
| 4,318,156 | 3/1982 | Gallagher | 361/358 |
| 4,367,417 | 1/1983 | Casasanta | 439/502 |
| 4,415,217 | 11/1983 | Clabburn et al. | 439/488 |
| 4,423,306 | 12/1983 | Fox | 174/15.7 |
| 4,456,145 | 6/1984 | Frank | 439/142 X |
| 4,500,748 | 2/1985 | Klein | 174/121 A |
| 4,531,798 | 7/1985 | Baur et al. | 439/488 |
| 4,625,073 | 11/1986 | Breesch et al. | 174/72 R |
| 4,626,953 | 12/1986 | Nilssen | 361/63 |
| 4,671,896 | 6/1987 | Hasegawa et al. | 174/121 A X |

FOREIGN PATENT DOCUMENTS

| | | | |
|---|---|---|---|
| 52-59547 | 12/1978 | Japan | 439/650 |

OTHER PUBLICATIONS

Sale: Duraline "Rollover Outlet Block" sold more than one year before 6/22/88.

*Primary Examiner*—Neil Abrams
*Assistant Examiner*—Khie M. Nguyen
*Attorney, Agent, or Firm*—Sixbey, Friedman, Leedom & Ferguson

[57] ABSTRACT

A portable power distribution system for distributing electrical power under low light, emergency conditions is disclosed herein. The system generally comprises a plurality of power distribution cables, a plurality of power outlet blocks, each of which is connectable to one of the power distributing cables, wherein each block has at least one electrical receptacle on a first side, and a resilient, water-tight housing that is curved on a second side opposite to the first side and which includes a weight for gravity-biasing the receptacle away from a skyward, water-collecting orientation, and a plurality of connector assemblies, each of which has matable male and female connectors for interconnecting the power distribution cables and the power outlet blocks. Each of the male and female connectors has a resilient housing preferably integrally and solidly formed from an elastomeric material for forming a shock and water resistant covering around its conductive member. Moreover, the male and femal connectors of each connector assembly are matable by the application of a relatively low compressive force, but yet are disengagable only by the application of a relatively high tensile force, so that the system may be quickly and easily assembled, but will not disconnect as a result of the application of inadvertent tensile or compressive forces to the electrical connectors. Finally, the male and female connectors of each connector assembly have an integrally molded strip of luminescent strip material incorporated within their housing both to render the connectors easily visible, and to provide a visual guide for properly aligning the conductive members of each prior to the mating thereof.

22 Claims, 3 Drawing Sheets

EMERGENCY POWER DISTRIBUTION SYSTEM

BACKGROUND OF THE INVENTION

This invention relates to portable power distribution systems, and is specifically concerned with a power distribution system for use under low-light emergency conditions, such as an accidental fire in a building.

Emergency power distribution systems for use by firemen are known in the prior art. Such systems generally include a power cable that is connected to a power source (which may be the portable generator aboard a fire fighting vehicle) at one end, and to a plurality of power distribution cables at its other end. Power outlet blocks having receptacles may be connected at the ends of each of the power distribution cables. These power outlet blocks are generally rectangular in shape, and have housings formed from stamped metal to protect the receptacles which they house. The power distribution cable and outlet blocks are all interconnected by male and female connectors of blade-type connector assemblies of the type which may be inserted into standard 120 volt wall sockets. The conductive elements used in the male connectors typically include a pair of flat copper strips which are insertable into rectangular slots located in the female connectors. A ground-wire prong may also be included in each of the connector assemblies to minimize the possibilities of electrical shock and short-circuiting.

Such portable power distributing systems are often an indispensable component of the tools used by firemen in at least two respects. First, they are used to set up an emergency array of floodlights around and within the building being quenched. Such floodlights are often necessary as the smoke generated by fires creates an obscuring fog in the vicinity of the burning building that makes it very difficult for the firemen to manipulate water hoses into the proper positions to effectively quench the fire. Even in a situation where there is little or no smoke, many fires occur at night, and so an emergency array of floodlights is still necessary. Secondly, such power distribution systems provide electrical power for the smoke blowers used by modern fire departments to help dissipate the obscuring haze created by the smoke of a building fire.

While such prior art power distribution systems are generally capable of providing the electrical power needed by fire fighters under many conditions, the applicant has observed a number of shortcomings associated with the components used in such systems. For example, neither the housings of the outlet blocks or of the connector assemblies are capable of withstanding the crushing forces that the wheels of a fire fighting or other type of emergency vehicle can apply. This deficiency, coupled with the fact that the power distribution cables, connector assemblies and power outlet blocks associated with such systems are difficult to see under nighttime or smoky conditions, can sometimes result in the crushing and hence inoperability of on or more of the power outlet blocks or connector assemblies of the system. Such inoperability in turn results in the inability of the system to provide the power needed for the floodlights and smoke blowers at a particular location. The applicant has further observed that the power outlet blocks and connector assemblies have no provision for effecting a water-tight seal between the prongs and recesses of the male and female connectors. This is a serious shortcoming, as the outlet blocks and connector assemblies frequently become wet either by being inadvertently sprayed by fire hoses, or being immerse in the water that often collects in pools around the site of a fire as a result of the water sprayed from fire hoses. The resulting short-circuiting not only can result in a serious power outage, but can also be life-threatening to the fire fighters handling the power distribution system. The applicant has further observed that it is difficult for firemen to properly align and insert the blades and slots of the male and female connectors used in such prior art power distribution assemblies due to both the low ambient light conditions, and the tearing that the often toxic smoke often induces in the eyes of firemen. Finally, the applicant has observed that the male and female connectors of the electrical connector assemblies are prone to accidental disengagements hen a relatively small amount of tensile force is inadvertently applied to them, which may occur when a cable is run over by a fire fighting or emergency vehicle, or dragged to a new location, or even tripped over by a fire fighter or fleeing inhabitant of the burning building.

Clearly, there is a need for an emergency power distribution system having power outlet blocks and connector assemblies which are both crush-proof and waterproof. It would be desirable if both the power outlet blocks and the connector assemblies resisted the collection of water under wet conditions so that no power outages or life-threatening short-circuiting occurred during the assembly, use or disassembly of the system. Finally, it would be desirable if the conductive members encased in the connector assembles could be easily and quickly engaged, but yet were not easily disengagable, so that the electrical connection between such connector assemblies stayed in tact when an inadvertent tensile force was applied hereto.

SUMMARY OF THE INVENTION

Generally speaking, the invention is a portable power distribution system for distributing electrical power under emergency, low ambient light conditions that overcomes the aforementioned shortcomings of prior art systems. The system of the invention generally comprises a power distribution assembly having a power cable that is electrically connectable to an outlet of a power source at one end, and a plurality of power distribution cables connectable in parallel to the other end of the power cable. The system further comprises a plurality of power outlet blocks, each of which is connectable to one of the power distributing cables, wherein each block has at least one electrical receptacle on one side, and means for biasing the electrical receptacle from a skyward facing orientation to help prevent the receptacle from collecting water. Finally, the system comprises a plurality of connector assemblies, each of which has matable male and female connectors that contain at least one conductive member, wherein each of the connectors has a resilient, watertight housing for forming a shock and water resistant covering around its conductive member.

Each of the power outlet blocks may also have a resilient, watertight housing. However, the housings of the outlet blocks are curved on a side opposite to that of the receptacle which it contains and are further weighted so as to gravity-bias the receptacle away from a skyward facing orientation. In the preferred embodiment, the watertight housing is integrally and solidly formed from a elastomeric material, such as Neoprene®, and includes a strip of luminescent sheet material on one of its sides in order to render the power outlet block easily visible under low ambient light conditions. Each of the power outlet blocks may further include a plug attached thereto by a strap for creating a watertight seal around the receptacle and the receptacle is not in use. In the preferred embodiment, the outlet of the power source includes a receptacle that is canted with respect to the horizontal for both preventing the collection of water inside the receptacle, and minimizing stress on the power cable to which it is connected.

The male and female connectors of each of the connector assemblies are matable by the application of a compressive force therebetween, and are disengagable only by the application of a tensile force therebetween which is substantially greater than the compressive force. Such an arrangement allows the operator to easily mate the connector assemblies when the system is being set up, but helps to prevent an accidental disengagement of the male and female connectors when the cables connected thereto are dragged over uneven terrain, run over by a vehicle, or tripped over by an individual. In the preferred embodiment, the male and female connectors of each connector assembly are disengagable by a tensile force of no less than 40 pounds, and preferably about 30 pounds.

The conductive members of each of the male connectors may take the form of an array of cylindrical pins solidly formed from a conductive metal, wherein the distal end of each pin is tapered and the proximal end of each pin is circumscribed by a sleeve of elastomeric material. Each of the sleeves of elastomeric material may include a tapered proximal portion for facilitating the insertion of a pin into a complementary recess in the female connector. Moreover, each of these sleeves may include a portion having an enlarged diameter for both forming a displacement-type watertight seal between tee sleeve add the female recess, and for enhancing the strength of the mechanical engagement between the male and female connector. The female recesses may also include an 0-ring for providing still another watertight seal between the pins and recesses of the male and female connectors.

To facilitate the rapid mating between the male and female connectors, each such connector includes a portion of luminescent sheet material integrally molded into its respective housing. This sheet material not only renders the connectors easily visible under low ambient light conditions, but further provides a visual guide for properly aligning the conductive pins in the complementary recesses of the male and female connectors, respectively, prior to mating. The male and female connectors each may include flat side walls which are mutually alignable for providing a further visual and tactile guide for the proper alignment of the pins and recesses of each prior to mating.

Finally, the system may include extension cables releasably connectable between each of the power distribution cables and the power outlet blocks, wherein each extension cable is of a different length, and includes different colorations so that the relative length of an extension cable may be visually determined.

BRIEF DESCRIPTION OF THE SEVERAL FIGURES

DETAILED DESCRIPTION OF THE PREFERRED EMBODIMENT

Figures 1, 2A, 2B, 3:
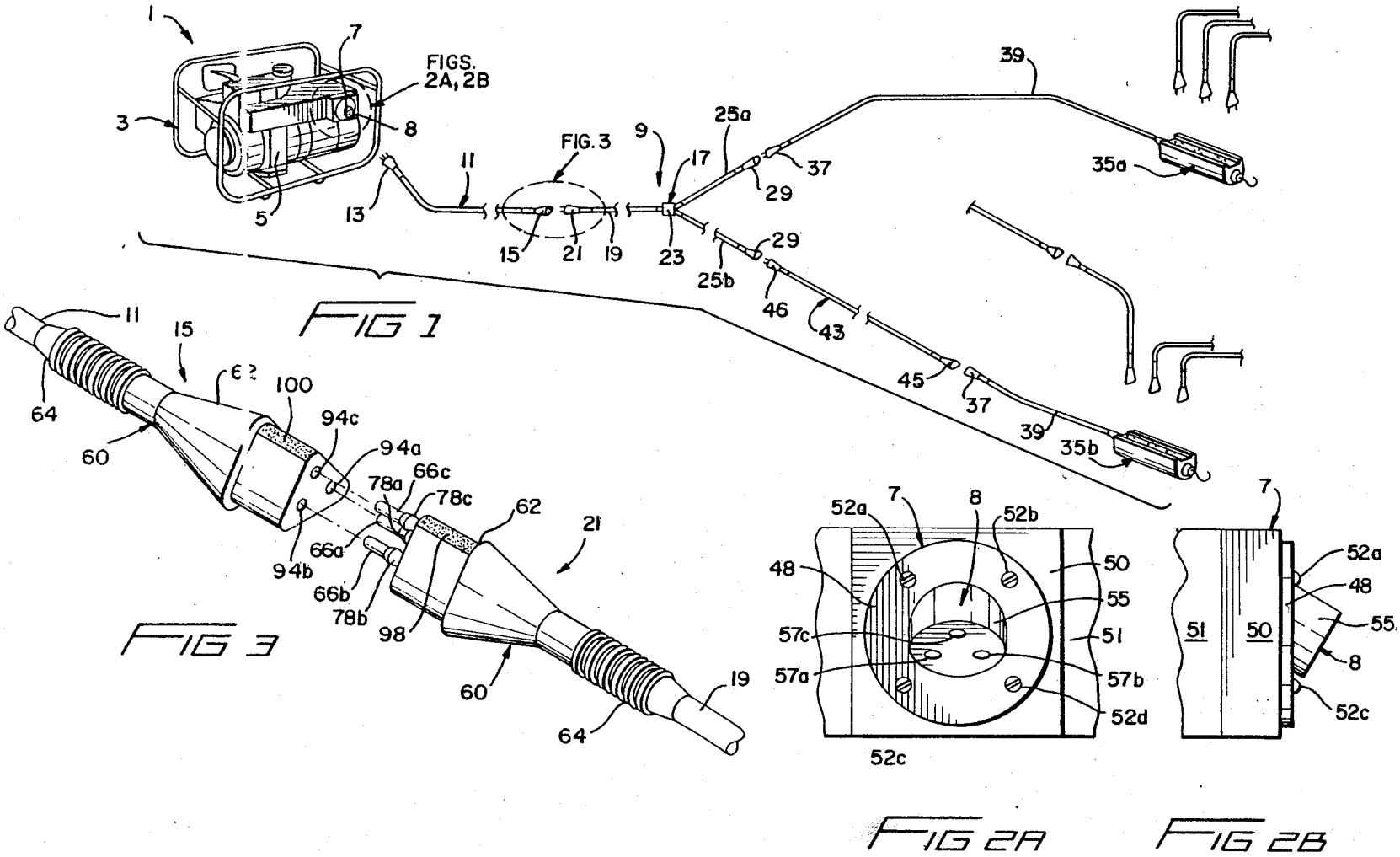
FIG. 1 is a perspective view of the emergency power distribution system of the invention.
FIGS. 2A and 2B are front and side views, respectively, of the power outlet used in the power distribution system of the invention.
FIG. 3 is a perspective view of the mating male and female connectors used in the invention.

With reference now to FIGS. 1, 2A and 2B, and 3 wherein like numerals designate like components throughout all of the several figures, the portable power distribution system 1 of the invention generally comprises a power source 3 having a gasoline powered generator 5, and outlet 7 having a female receptacle 8 mounted on the side of the power source 3, and power distribution network 9 that generally includes power cable 11, a siamese junction 17, and power outlet blocks **35*a*, 35*b***.

The power distribution network 9 includes a power cable 11 having a male connector 13 at one end that is electrically connectable to the female receptacle 8 of the outlet 7, and a female connector 15 at its other end. The siamese junction 17 includes an inlet cable 19 that terminates in a male connector 21 that is electrically connectable to the female connector 15 of the power cable 11, as well as junction block 23 wherein a pair of outlet cables **25*a*, 25*b* are connected in parallel to the inlet cable 19. Each of the outlet cables 25*a*, 25*b* terminates in a female connector 29*a*, 29*b*. Each of these female connectors 29*a*, 29*b* is in turn electrically connected to a rollover-type power outlet block 35*a*, 35*b* either directly by way of the male connector 37 of a power outlet block cable 39 (as is the case with outlet cable 25*a*) or indirectly by way of an extension cable 43 having female and male connectors 45, 46 as shown. In the preferred embodiment, extension cable 43 includes a distinctive coloration which is associated with its length. For example, a 25 foot extension cable 43 may be colored high visibility yellow, while a 50 foot extension cable 43 may be colored high visibility orange. The coloration of such extension cables 43 (of which only one is shown in FIG. 1) greatly facilitates the initial assembly of the power distribution network 9, since the persons assembling the network 9 can tell, at a glance, the exact length of any particular extension cable 43 used to connect a power outlet block 35 to either of the outlet cables 25*a*, 25*b* of the siamese junction 17. In the preferred embodiment, each extension cable 43 (as well as the siamese junction 17 and the power cable 11) includes a heavy sheath of Neoprene®approximately one-eighth of an inch thick to protect the electrical wires contained therein from both water and shock. Moreover, the various color codes associated with each of the extension cables 43** are preferably directly impregnated into the Neoprene®sheath that forms the outside surface of each of these cables.

With specific reference now to 2A and 2B, the female receptacle 8 of the power source outlet 7 is circumscribed by a circular mounting flange 48 as shown which in turn is mounted onto to the connector block 50 of a connector panel 51 by means of screws 52*a*–52*d*. In the preferred embodiment, both the female receptacle and circular mounting flange 48 are integrally formed of Neoprene®. Moreover, the receptacle 8 is provided with a neck 55 which projects the three-pin receiving recesses 57*a*–57*c* at a downward angle with respect to the horizontal, as is most easily seen with respect to FIG. 2B. The downward slope of the neck 55 of the female receptacle 8 advantageously prevents the receptacle 8 from accumulating water, and also serves to reduce the stress on any male plug engaged thereto. In FIG. 1, the power source outlet 7 is shown mounted onto the connector panel 51 of a gasoline powered generator 5. However, the power source outlet 7 may just as easily be connected to and used in conjunction with the power source (not shown) of a fire truck.

FIG. 3 illustrates the kind of male and female connectors 21, 15 used throughout the power distribution network 9. Each of the male connectors 21 has a connector body 60 formed from solid Neoprene®that includes a distal plug portion 62, and a proximal stress relief portion 64 that circumscribes the end of its respective cable 65. Each of the male connectors 21 has three pins 66*a*–66*c* arranged in the form of an isosceles triangle. Such a configuration advantageously "keys" tee pins 66*a*–66*c* so that they may be inserted into the complementary recesses 94*a*–94*c* in each of the female connectors 15 in only one orientation, thus insuring that the ground wire (which is connected to pin 66*c* in the preferred embodiment) is always connected to the ground recess 94*c* while the two current carrying wires 66*a* and 66*b*are always connected to current carrying recesses 94*a* and 94*b* in the female connector 15.

Figure 4A:
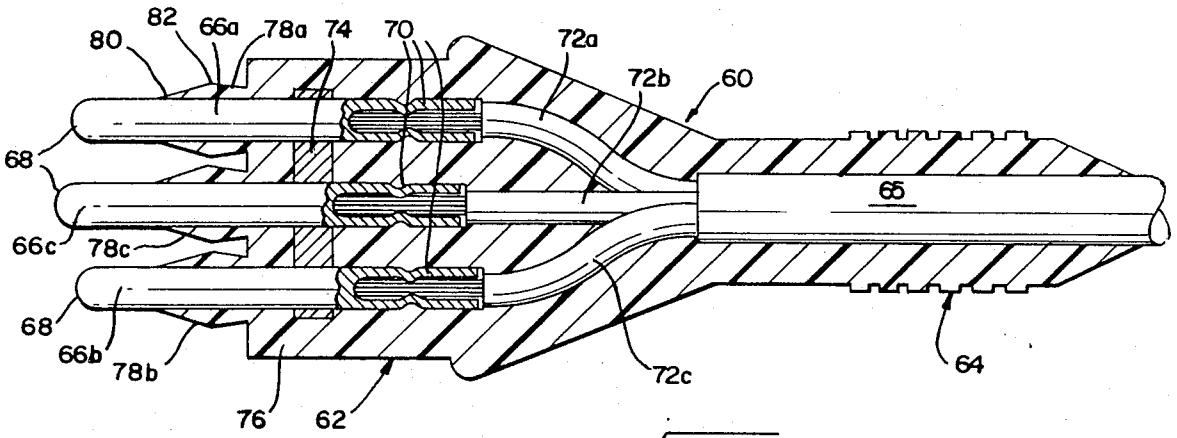
FIGS. 4A and 4B are a cross-sectional side view and a front view, respectively, of one of the male connectors used in the invention.
Figure 4B:
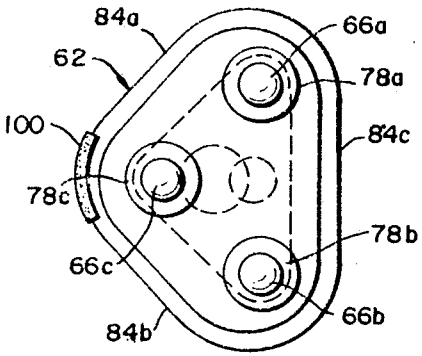
Figure 5B:
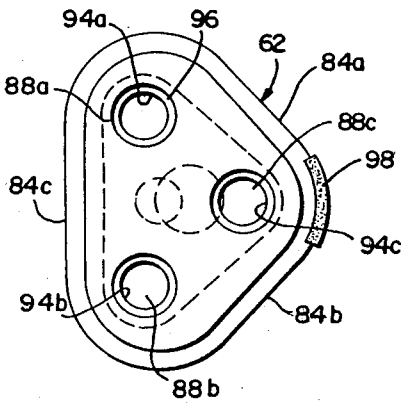
FIGS. 5A and 5B are a cross-sectional side view and a front view, respectively, of one of the female connectors used in the invention.
Figure 5A:
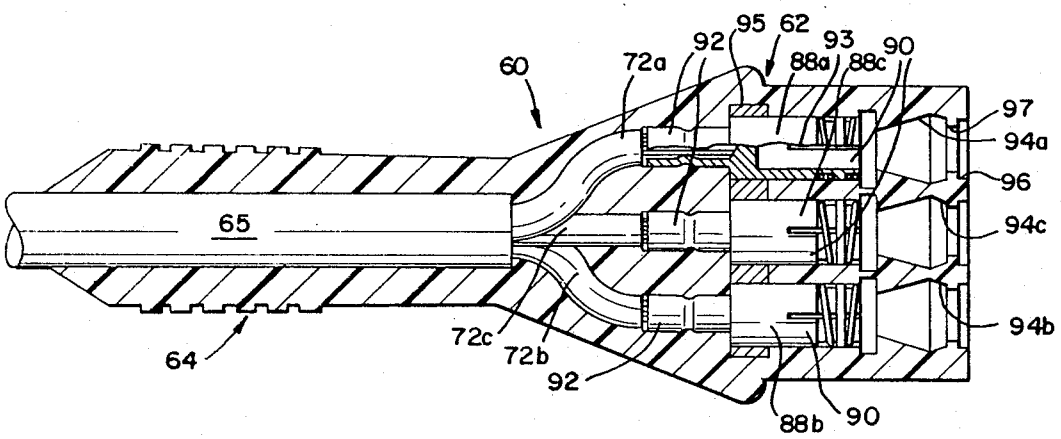

With reference now to FIG. 3 and FIGS. 4A and of the pins 66*a*–66*c* of the male connector 21 includes a tapered or rounded distal end 68 that is preferably formed from solid copper or solid brass for both strength and conductivity, as well as a proximal end that includes a wire receiving cup 70 that may be crimped over the appropriate wire of the cable 65. In the preferred embodiment, each of the cable pins 66*a*–66*c* is preferably approximately one-fourth of an inch in diameter. Such a solid, cylindrical shape in combination with the solid Neoprene®construction of the surrounding connector body 60 renders the male connector 21 operable even if run over by a fire truck or other heavy vehicle. As is best seen with respect to FIG. 4A, the base portions that each of the electrically conducted pins 66*a*–66*c* extends through is solidly secured to a bore in a triangular strain relief anchor 74 which is preferably integrally formed from nylon or some other high-strength, nonconductive plastic material. Overlying the strain relief anchor 74 is a cap member 76 which is formed from Neoprene®that is integrally molded into the plug portion 62 of the connector 21. Such molding of the cap 76 into the plug portion 62 effectively "pots" the pins 66*a*–66*c* and the strain relief anchor 74 within the plug portion 62 of the connector body 60. It should be noted that the strain relief anchor 74 not only enhances the mechanical connection between each of the pins 66*a*–66*c* and the plug portion 62 of the body 60, but also serves to maintain the triangular configuration of the pins 66*a*–66*c* with respect to the plug portion 62 by greatly increasing the sheer strength of these pins.

The integrally molded Neoprene®cap 76 that forms the distal end of the plug portion 62 includes three sleeves 78*a*–78*c* which circumscribe the mid portions of each of the pins 66*a*–66*c* as is best seen in FIG. 4A. With specific reference to sleeve 78*a*, each of sleeves 78*a*–78*c* includes a tapered end portion 80 for facilitating insertion into one of the complementary recesses of a female connector, as well as an enlarged portion 82 just behind the tapered end portion 80. The enlarged portion 82 of each of the sleeves 78*a*–78*c* not only strengthens the mechanical engagement between the male and female connectors 21 and 15, but further creates a displacement-type watertight seal between two mated connectors that serves both to "squeeze-out", via displacement, any water that may have collected in the recesses 94*a*–94*c* of the female connector 15 when the two are mated, but also creates one of the two seals between the connectors 15 and 21 that prevents water from seeping up into the conductive parts of the female connectors 15. Such watertight sealing advantageously prevents short circuiting from occurring between mating connectors and a wet portion of ground, or more seriously, the hand of a person assembling or otherwise handling the power distribution network 9.

The male connector 21 (as well as the female connector 15) includes flat side walls 84*a*, 84*b* and 84*c* arranged in the same isosceles-triangular configuration as the conductive pins 66*a*–66*c*. The provision of such side walls 84*a*–84*c* of manifestly different sizes around the plug portion 62 of the connector 21 provides both a visual and a tactile signal to the person assembling the distribution network 9 as to when the conductive pins 66*a*–66*c* of a male connector 21 are properly aligned with the complementary recesses 94*a*–94*c* of a female connector 15.

The female connector 15 has essentially the same parts as the previously discussed male connector 21, with the exception that it includes three connector barrels 88*a*–88*c* instead of conductive pins 66*a*–66*c*, and recesses 94*a*–94*c*. instead of the previously described sleeves 78*a*–78*c*. As is specifically shown with respect to barrel 88*a*, each of the connector barrels 88*a*–88*c* includes an open distal end 90, and a proximal end including a wire receiving cup 92 which is preferably crimped over its appropriate wire 72*a*–72*c*. Like the previously discussed conductive pins 66*a*–66*c*, each of the connector barrels 88*a*–88*c* is preferably formed from copper. Each of these barrels further includes a slot 93 so that the barrels 88*a*–88*c* can resiliently engage the rounded distal ends 68 of the conductive pins 66*a*–66*c* that they receive when the male and female connectors 21, 15 are mated. Immediately disposed above the each of the connector barrels 88*a*–88*c* are the previously mentioned recesses 94*a*–94*c* which are complementary in shape to the sleeve 78*a*–78*c* which circumscribe the base portions of the pins 68*a*–68*c* of the male connector 21. The complementary shape of these recesses 94*a*–94*c* in combination with the resiliency afforded by the Neoprene®forming the plug portion 62 provides a secure, watertight engagement between the connectors 21 and 15 when they are mated, and results in the positive displacement of any water that might have collected in the recesses 94*a*–94*c*. The enlarged portions 82 of each of the sleeves 78*a*–78*c* interlocks the connectors 21 and 15 to the extent to where the force required to disengage the connector 15, 21 is substantially greater than the force required to initially mate them together. This feature is achieved by providing a taper angle on the distal side of each of the enlarged portions 82 that is deliberately made shallower than the taper angle on the proximal side of these portions 82. In the preferred embodiment, the relative hardness of the Neoprene® forming the male and female connectors and the taper angles of the enlarged portions 82 of the sleeves 78a–78c are both chosen so that about 30 pounds of tensile force is required to separate mated male and female connectors 21 and 15, while only about 15 pounds of compressive force is required to mate the connectors. Such dimensioning makes it fairly easy to mate the connectors, but renders it difficult, if not impossible, for mated connectors to become inadvertently detached when run over by a heavy vehicle, or tripped over by a user of the emergency power distribution system 1.

A strain relief anchor 95 is provided around the distal ends of the connector barrels 88a–88c as shown which functions analogously with respect to said barrels 88a–88c as the strain relief anchor 74 does for conductive pins 66a–66c. Additionally, the distal ends of the each of the complementary recesses 94a–94c are circumscribed by stepped recesses 96 that perform two functions. First, the annular flange 97 of Neoprene®defined by each of the stepped recesses 96 snugly engages the circumference of any male pin inserted in the recesses 94a–94c and forms a second watertight seal that assists the first watertight seal provided by the interfitting of the enlarged portions 82 of the sleeves 78a–78c of the male corner 21 and the recesses 94a–94c. Second the stepped recesses 96 each are capable of resiliently receiving the complementary-shaped plugs of water sealing caps such as those illustrated on FIG. 6C with respect to the power outlet block 35 in order to prevent water from collecting in the recesses 94a–94c when the female connector 15 is not mated to a male connector 21.

To further assist the system assembler in rapidly and correctly mating the male and female connectors 21 and 15 throughout the network 9, luminescent sheet material 98, 100 is integrally molded adjacent to the ground pin 66c of the male connector 21 and the ground connector barrel 88c of the female connector 15. Such luminescent tape not only helps the assembler of the network 9 to rapidly find the male and female connectors 21 and 15 throughout the network 9, but also provides a visual signal which is useful in informing the assembler when the pins 66a–66c of the male connector 21 are in alignment with the recesses 94a–94c of the female connector 15. The integral molding of the luminescent sheet material 98, 100 directly into the Neoprene® which forms the body of both the male and female plugs 21, 15 insures that this sheet material 98, 100 will not become detached from its respective connector.

Figure 6B:
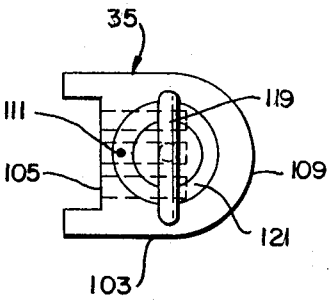
FIGS. 6A and 6B are a side view and top view of one of the power outlet blocks used in the invention.
Figure 6A:
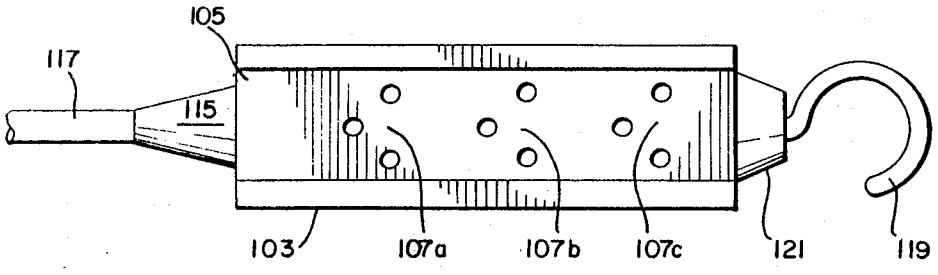

With reference now to FIGS. 6A and 6B, each of the power outlet blocks 35a, 35b of the system 1 includes a block body 103 that is likewise integrally block body 103 includes three female outlets 107a–107c, while the back side 109 is rounded in semicircular shape as is best seen in FIG. 6B. The flat, front side 105 and the rear, rounded side 109 are proportioned such that the center of gravity 111 of the block body 103 is substantially closer to the front side 105 as is illustrated in 6B. Such proportioning causes gravity to bias the front side 105 of the block 35 downwardly so that the power outlet block 35 either assumes a position on its side as illustrated in 6B, or with its front side 105 facing the ground. Either of these positions is preferred over a skyward facing orientation which could cause the pin-receiving recesses of the three outlets 107a–107c to collect falling water from hoses and short-circuit.

As is further seen best in FIG. 6B, a pair of parallel, integrally molded standoffs 113a, 113b are provided along each side of the block body 103 of the power outlet block 35, for two reasons. First, when the front side 105 of the power outlet block 35 assumes a downward-facing orientation, these stand-offs 113a, 113b help to raise the pin-receiving recesses of the three outlets 107a–107c above any standing water which may be on the ground. Secondly, these standoffs 113a, 113b help to advantageously move the center of gravity 111 of the block body 103 further toward the front side 105, thus increasing the gravity bias on the block 35 that serves to keep the front side 105 from assuming a skyward-oriented position.

As is best seen with respect to both 6A and 6C a hook 119 is provided on top of the block body 103. This hook 119 is preferably connected to the body 103 by means of a swiveling connection 121. The provision of such a hook 119 allows the power outlet block 35 to be conveniently suspended over pools of standing water which might be created by either rain or the water discharged from fire hoses.

Figure 6C:
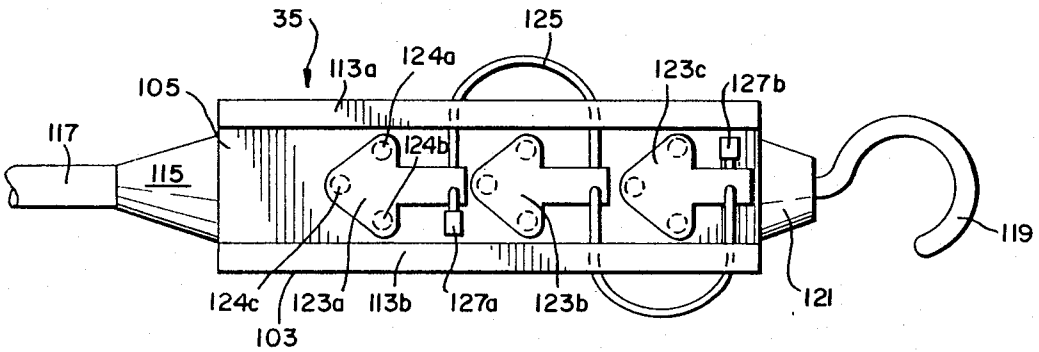
FIG. 6C is a side view of the power outlet block illustrated in FIG. 6A shown with detachably connectable outlet caps.

Finally, with respect to FIG. 6C, each of the power outlet blocks 35 may include water caps 123a, 123b, 123c having resilient Neoprene®plugs 124 which snap-fit within the stepped-recesses 96 circumscribing the outer edges of the pin-receiving recesses 94a–94c in each female connector or outlet. In the preferred embodiment, each of these caps 123a–123c is attached onto the block body 103 of the power outlet block 35 by means of an anchor cord 125 that is sinuously inserted through bores provided in the standoffs 113a, 113b as shown. The ends of the anchor cord 125 are provided with lead seals 127a, 127b to prevent the caps 123a–123c and cord 125 from being removed from the block body 103.

What is claimed:

1. A portable power distribution system for distributing electrical power under emergency conditions, comprising:

a. a source of electrical power having an outlet;

b. a power distributing assembly having a power cable that is electrically connectable to the outlet of the power source at one end, and a plurality of power distribution cables connectable to the other end of said power cable;

c. a plurality of power outlet blocks, each of which is connectable to one of said power distributing cables, wherein each block has a least one electrical receptacle on a first side, and a resilient, watertight housing that is curved on a second side opposite to said first side and which includes a weight means for gravity-biasing said receptacle away from a skyward facing orientation to help prevent said receptacle from collecting water, and d. a plurality of connector assemblies, each of which has matable male and female connectors that contain a conductive member for electrically and mechanically connecting said power cable, and said power distribution blocks to said distribution cables, wherein each male and female connector has a resilient housing for forming a shock and water resistant covering around its conductive member, wherein the male and female connectors each include a luminescent display means for both rendering said connectors easily visible, and for providing a visual guide for properly aligning the conductors of said connectors prior to the mating thereof, and e. a plurality of extension cables releasably connectable between each of the power distribution cables and said power outlet blocks, wherein each extension cable is of different length, and includes different coloration so that each extension cable can be easily seen under low-light conditions, and its relative length easily visually determined.

2. A portable power distribution system as defined in claim 1, wherein the conductive members of the male and female connectors of each connector assembly are matable by the application of a compressive force therebetween, and are disengagable by the application of a tensile force therebetween which is substantially greater than said compressive force.

3. A portable power distribution system as defined in claim 1, wherein the male and female connectors of each connector assembly are disengagable by a tensile force of between about 20 and 40 pounds.

4. A portable power distribution system as defined in claim 2, wherein said male connector includes a plurality of conductive members, each of which is formed from a cylindrical pin of a conductive metal, and wherein each pin is circumscribed at its proximal end by a sleeve of elastomeric material, and wherein said female connector includes a plurality of recesses in its resilient housing that are complementary in shape to the pins and their surrounding sleeves of said male connector for resiliently receiving said pins and sleeves, to both displace any water that may have collected in said recesses and form a watertight engagement therebetween.

5. A portable power distribution system as defined in claim 4, wherein said pins and their surrounding elastomeric sleeves includes a tapered distal portion to reduce the amount of compressive force necessary to mate said male connector with said female connector.

6. A portable power distribution system as defined in claim 1, wherein said power outlet blocks each include a recess surrounding said receptacle, and a closure means sealingly engagable within said recess for sealing said receptacle against water.

7. A portable power distribution system as defined in claim 1, wherein said outlet of said power source includes a receptacle that is canted with respect to the horizontal for both minimizing the stress on the power cable to which it is connectable and for preventing the collection of water inside said receptacle.

8. A portable power distribution system as defined in claim 1, wherein the housing of said male and female connectors includes flat sidewalls which are mutually alignable for providing a visual and tactile guide for properly aligning the conductors of said connectors prior to the mating thereof.

9. A portable power distribution system for distribution electrical power under emergency conditions characterized by a low level of ambient light, comprising:

a. a power distributing assembly having a power cable that is electrically connectable to an outlet of a power source at one end, and a plurality of power distribution cables connectable in parallel to the other end of said power cable;

b. a plurality of power outlet blocks, each of which is connectable to one of said power distributing cables, wherein each block has at least one electrical receptacle on one side, and c. a plurality of connector assemblies, each of which has matable male and female connectors that contain at least one conductive member, wherein each male and female connector has a resilient housing for forming a shock and water resistant covering around its conductive member, wherein the conductive members of the male and female connectors of each connector assembly are matable by the application of a compressive force therebetween, and are disengagable by the application of a tensile force therebetween which is substantially greater than said compressive force, and d. a plurality of extension cables releasably connectable between each of the power distribution cables and said power outlet blocks, wherein each extension cable is of different length, and includes different coloration so that each extension cable can be easily seen under low-light conditions, and its relative length easily visually determined.

10. A portable power distribution system as defined in claim 9, wherein each of the outlet blocks includes a luminescent display means for rendering said blocks easily visible under low ambient light conditions.

11. A portable power distribution system as defined in claim 9, wherein each of the power outlet blocks includes means for gravity biasing said receptacle away from a skyward facing orientation.

12. A portable power distribution system as defined in claim 9, wherein each of the power outlet blocks includes a plug means for creating a watertight seal in its respective receptacle prior to the insertion of a male connector therein.

13. A portable power distribution system as defined in claim 9, wherein said male connector includes a plurality of conductive members, each of which is formed from a cylindrical pin of a conductive metal, and wherein each pin is circumscribed at its proximal end by a sleeve of elastomeric material, and wherein said female connector includes a plurality of recesses in its resilient housing that are complementary in shape to the pins and their surrounding sleeves of said male connector for resiliently receiving said pins and sleeves to displace out any water present in said recesses and to form a watertight engagement therebetween.

14. A portable power distribution system as defined in claim 13, wherein said pins and their surrounding elastomeric sleeves includes a tapered distal portion to minimize the amount of compressive forces necessary to mate said male connector with said female connector.

15. A portable power distribution system as defined in claim 14, wherein each of said sleeves includes a tapered proximal portion behind its tapered distal portion which is tapered at a larger angle so that the amount of tensile force necessary to disengage said male and female connectors is larger than the amount of compressive force necessary to engage them.

16. A portable power distribution system as defined in claim 9, wherein the male and female connectors each include a luminescent display means for both rendering said connectors easily visible, and for providing an visual guide for properly aligning the conductors of said connectors prior to the mating thereof.

17. A portable power distribution system as defined in claim 9, wherein the housing of said male and female connectors includes flat sidewalls which are mutually alignable for providing a visual and tactile guide for properly aligning the conductors of said connectors prior to the mating thereof.

18. A portable power distribution system as defined in claim 9, wherein the housing of said male and female connectors is formed from solid Neoprene.

19. A portable power distribution system as defined in claim 9, wherein each of said power outlet blocks includes a housing formed from substantially solid Neoprene ® that is flat on a first side that present said receptacle, and curved on a side opposite to said first side, and which includes a weight means for biasing said flat first side away from a skyward facing orientation.

20. A portable power distribution system as defined in claim 9, further including an outlet connected to a source of power, wherein said outlet includes a receptacle that is canted with respect to the horizontal and which is connectable to said power cable.

21. A portable power distribution system as defined in claim 19, wherein said luminescent display means is a sheet of luminescent material that is molded into the resilient housing of both the male and female connectors.

22. A portable power distribution system for distribution electrical power under emergency conditions characterized by a low level of ambient light, comprising:

a. a power distributing assembly having a power cable that is electrically connectable to an outlet of a power source at one end, and a plurality of power distribution cables connectable in parallel to the other end of said power cable;

b. a plurality of power outlet blocks, each of which is connectable to one of said power distributing cables, wherein each block has at least one electrical receptacle on one side, and c. a plurality of connector assemblies, each of which has matable male and female connectors that contain at least one conductive member, wherein each male and female connector has a resilient housing for forming a shock and water resistant covering around its conductive member, wherein said male connector includes a plurality of conductive members, each of which is formed from a cylindrical pin of a conductive metal, each pin being circumscribed at its proximal end by a sleeve of elastomeric material, and wherein said female connector includes a plurality of recesses in its resilient housing that are complementary in shape to the pins and their surrounding sleeves of said male connector for resiliently receiving said pins and sleeves to displace out any water present in said recesses and to form a watertight engagement therebetween, said pins and their surrounding elastomeric sleeves including a tapered distal portion to minimize the amount of compressive forces necessary to mate said male connector with said female connector, and each of said sleeves, including a tapered proximal portion behind its tapered distal portion which is tapered at a larger angle so that the amount of tensile force necessary to disengage said male and female connectors is larger than the amount of compressive force necessary to engage them.

* * * * *